United States Patent [19]

Kobayashi et al.

[11] Patent Number: 4,830,086

[45] Date of Patent: May 16, 1989

[54] MOLD MEMBER AND RAPIDLY SOLIDIFYING WATER COOLED ROTARY ROLL MEMBER

[75] Inventors: Masao Kobayashi; Takuro Iwamura, both of Ohmiya-city; Kazuhiko Tabei, Asikaga-city, all of Japan

[73] Assignee: Mitsubishi Kinzoku Kabushiki Kaisha, Tokyo, Japan

[21] Appl. No.: 238,081

[22] Filed: Aug. 30, 1988

[30] Foreign Application Priority Data

Aug. 31, 1987 [JP] Japan ..... 62-217192
Sep. 17, 1987 [JP] Japan ..... 62-233482

[51] Int. Cl.[4] ..... B22D 11/04; B22D 11/06

[52] U.S. Cl. ..... 164/418; 164/428; 420/488

[58] Field of Search ..... 164/418, 428, 459, 138; 249/135; 420/488

[56] References Cited

U.S. PATENT DOCUMENTS 4,377,424 3/1983 Hirao et al. ..... 420/488 X
4,589,930 5/1986 Kumagai ..... 164/418 X
4,780,275 10/1988 Grefkes et al. ..... 420/488 X

FOREIGN PATENT DOCUMENTS 53-70923 6/1978 Japan ..... 164/459
55-128351 10/1980 Japan ..... 164/418
57-112946 7/1982 Japan ..... 164/418
58-212839 12/1983 Japan ..... 164/418
61-106737 5/1986 Japan ..... 164/418
61-153246 7/1986 Japan ..... 420/488

*Primary Examiner*—Nicholas P. Godici
*Assistant Examiner*—J. Reed Batten, Jr.
*Attorney, Agent, or Firm*—Armstrong, Nikaido, Marmelstein, Kubovcik & Murray

[57] ABSTRACT

A mold member and a rapidly solidifying water cooled rotary roll member contain 1.3 to 5% of Ni, 0.2 to 2% of Ti, 0.1 to 1.5% of Cr, 0 to 0.5% of Zr, 0 to 1% of Al, 0 to 0.5% of at least one of Fe and Co, 0 to 1.2% of Sn, 0 to 1.2% of Mn, 0 to 1.2% of Zn, 0 to 0.2% of Mg, 0 to 0.2% of P, and 0 to 0.2% of a rare earth element, wherein the remainder of the material has a composition consisting of Cu and unavoidable impurities. Each of the members has superior thermal fatigue resistance and erosion resistance against molten metal, high-temperature strength, high-temperature hardness, high-temperature ductility and heat resistance.

4 Claims, 3 Drawing Sheets

MOLD MEMBER AND RAPIDLY SOLIDIFYING WATER COOLED ROTARY ROLL MEMBER

BACKGROUND OF THE INVENTION

1. Field of the Invention

The present invention relates to a member which must have excellent high-temperature strength, high-temperature hardness, thermal fatigue resistance, and erosion resistance against molten metal, i.e., a casting mold and, more particularly, to a rapidly solidifying water cooled rotary roll member for a molten metal exposed to a severe thermal fatigue environment.

2. Prior Art

Generally, a normal continuous casting mold and the above water cooled rotary roll must have high-temperature characteristics such as a thermal conductivity for reducing a local thermal stress, a high-temperature strength against a large thermal stress, a high-temperature elongation against a severe thermal fatigue environment, and a high-temperature hardness or erosion resistance against molten metal for preventing erosion on a mold surface caused by erosion during casting because surface quality of a cast product is significantly degraded if erosion occurs. This erosion is significant especially in the water cooled rotary roll and a roll service life is determined by the erosion. Therefore, in order to obtain the above characteristics, a Cu-Cr alloy, a Cu-Zr alloy, or a Cu-Cr-Zr alloy is conventionally used.

Recently, in accordance with needs for higher productivity, casting molds have been used under severe environments. Especially, along with developments in continuous casting techniques such as a electromagnetic stirring technique, a surface temperature of a mold which is in contact with a molten metal has been gradually increased from 300° to 400° C. to 400° to 500° C.

Furthermore, in order to obtain various excellent characteristics, a rapidly solidified thin plate is manufactured by a water cooled rotary roll made of various alloys such as silicon steel. In this case, a surface of the roll is exposed to a high temperature of 500° C. even when the roll is used. In addition, since a molten metal is continuously supplied to the same portion, a thermal stress locally acts, and the same time, the roll which rotates at high peripheral speed of which reaches 2 to 40 m/sec. is locally, frequently, and repeatedly heated and cooled. In a normal continuous casting method, when casting reaches a stable state, both the magnitude and distribution of a thermal stress acting on a mold are maintained substantially constant until casting is completed. However, in the above case, the mold is locally exposed to severe thermal fatigue or thermal cycle fatigue generating conditions.

When the continuous casting mold or the water cooled rotary roll manufactured by a conventional Cu alloy is used under the above severe conditions, a service life of the mold is degraded because the high-temperature characteristics, especially the high-temperature strength, the high-temperature hardness, and the erosion resistance against molten metal are insufficient. Especially for the water cooled rotary roll, this problem is critical in practical applications.

As a result of extensive studies for developing a material which has superior high-temperature characteristics and hence can be used not only as a normal continuous casting mold but also as a water cooled rapidly solidifying roll mold which must have better characteristics, the present inventors have found that a Cu alloy containing 1.3 to 5% (% is wt% hereinafter) of Ni, 0.2 to 2% of Ti, 0.1 to 1.5% of Cr, 0 to 0.5% of Zr, 0 to 1% of Al, 0 to 0.5% of at least one of Fe and Co, 0 to 1.2% of Sn, 0 to 1.2% of Mn, 0 to 1.2% of Zn, 0 to 0.2% of Mg, 0 to 0.2% of P, and 0 to 0.2% of a rare earth element, wherein the remainder of said material has a composition consisting of Cu and unavoidable impurities, has excellent high-temperature strength, high-temperature hardness, high-temperature ductility, heat resistance, thermal fatigue resistance, and erosion resistance against molten metal. The present inventors have also found that when the above Cu alloy is used as a member such as a rapidly solidifying water cooled rotary roll which is exposed to a severe thermal fatigue environment in which a large thermal stress is locally repeatedly produced by contact with a molten metal, a service life of the member is significantly improved to achieve a stable performance for a long time period.

The present invention has been made in consideration of the above findings.

SUMMARY OF THE INVENTION

Accordingly, it is an object of the present invention to provide a mold member having excellent high-temperature strength, high-temperature hardness, high-temperature ductility, heat resistance with good balance and having superior thermal fatigue resistance and erosion resistance against molten metal.

Another object of the present invention is to provide a rapidly solidifying water cooled rotary roll member having a high performance over a significantly long time period, the alloy being also used as a continuous casting mold which must be formed thinner because an electromagnetic stirring technique has been developed.

According to a first apsect of the present invention, there is provided a mold member containing 1.3 to 5% of Ni, 0.2 to 2% of Ti, 0.1 to 1.5% of Cr, 0 to 0.5% of Zr, 0 to 1% of Al, 0 to 0.5% of at least one of Fe and Co, 0 to 1.2% of Sn, 0 to 1.2% of Mn, 0 to 1.2% of Zn, 0 to 0.2% of Mg, 0 to 0.2% of P, and 0 to 0.2% of a rare earth element, wherein the remainder of the material has a composition consisting of Cu and unavoidable impurities.

According to a second aspect of the present invention, there is provided a rapidly solidifying water cooled rotary roll member containing 1.3 to 5% of Ni, 0.2 to 2% of Ti, 0.1 to 1.5% of Cr, 0 to 0.5% of Zr, 0 to 1% of Al, 0 to 0.5% of at least one of Fe and Co, 0 to 1.2% of Sn, 0 to 1.2% of Mn, 0 to 1.2% of Zn, 0 to 0.2% of Mg, 0 to 0.2% of P, and 0 to 0.2% of a rare earth element, wherein the remainder of the material has a composition consisting of Cu and unavoidable impurities.

The reason why the composition of the Cu alloy is limited to the above one will be described below.

(a) Ni and Ti

These components have a function of forming an intermetallic compound of NixTiy such as $NiTi_2$, $Ni_3Ti$, and the like, the intermetallic compound being finely precipitated in a crystal grain in a matrix, thereby significantly improving the high-temperature strength and the high-temperature hardness or erosion resistance against molten metal of the alloy. However, if the content of Ni is less than 1.3% and that of Ti is less than 0.2%, a desired effect cannot be obtained in the above function. Meanwhile, if the contents of Ni and Ti exceed 5% and 2%, respectively, the function is saturated, and therefore a further improvement cannot be obtained. In addition, the thermal conductivity is abruptly reduced. Therefore, the contents of Ni and Ti are determined to be 1.3% to 5% and 0.2% to 2%, respectively.

(b) Cr

A Cr component is finely precipitated in a crystal grain to improve the strength of an alloy and significantly improves the high-temperature strength and the high-temperature hardness or erosion resistance against molten metal together with Ni and Ti. However, if the content of Cr is less than 0.1%, a desired effect cannot be obtained in the above function. Meanwhile, if the content exceeds 1.5%, not only a desired effect cannot be obtained, but also a primarily crystallized coarse Cr is produced to significantly degrade the ductility. In addition, if the content exceeds 1.5%, it becomes difficult to perform melting and casting. Therefore, the content of Cr is determined to be 0.1 to 1.5%.

(c) Zr

A Zr component is contained because it is bonded to Cu to form a fine intermetallic compound $Cu_3Zr$ mainly in a grain boundary and therefore suppresses sliding of the grain boundary at a high temperature. As a result, embrittlement or ductility reduction caused by grain boundary breaking is prevented to improve the thermal fatigue resistance. However, if the content of Zr exceeds 0.5%, a further improvement cannot be obtained in the above function. On the contrary, the ductility is reduced, and melting and casting become difficult. Therefore, the content of Zr is determined to be 0.5% or less.

(d) Al

An Al component is contained if necessary because it is bonded to Ni and Ti to precipitate a fine intermetallic compound NixAly such as $NiAl_3$, $Ni_2Al_3$, $Ni_5Al_3$, $Ni_3Al$ and the like, or TixAly such as $Ti_3Al$, TiAl, $TiAl_3$ and the like, thereby improving the room-temperature and high-temperature strengths of the alloy. In addition, in a practical use, the Al component forms a dense layer in which $Al_2O_3$ is dispersed on the surface of the alloy to reduce the wettability with respect to a molten metal, thereby significantly suppressing erosion of, e.g., a water cooled rotary roll mold used in a roll method. However, if the content of Al exceeds 1%, a further improvement cannot be obtained in the above function. On the contrary, the thermal conductivity is degraded. Therefore, the content is determined to be 1% or less.

(e) Fe and Co

These components are contained if necessary because they are bonded to Ti to form an intermetallic compound (Fe,Co)xTiy such as FeTi, $CoTi_2$, CoTi, $Co_2Ti$, $Co_3Ti$, and the like, the intermetallic compound being finely precipitated in a crystal grain, thereby improving the strength and the thermal conductivity of the alloy. However, if the content of at least one of Fe and Co exceeds 0.5%, a further improvement cannot be obtained in the above function. On the contrary, the thermal conductivity is abruptly degraded. Therefore, the content of at least one of Fe and Co is determined to be 0.5% or less.

(f) Sn, Mn, Zn, Mg, P

These components, which are called heat resistance reinforcing components hereinafter, are contained if necessary because they have a function of improving the heat resistance and the strength of the alloy. However, if the content of Sn, Mn, or Zn exceeds 1.2%, and that of Mg or P exceeds 0.2%, respectively, the ductility and the thermal conductivity are significantly degraded although the strength can be improved. Therefore, the contents of Sn, Mn, Zn, and P are determined to be 1.2% or less, 1.2% or less, 1.2% or less, 0.2% or less, and 0.2% or less, respectively.

(g) Rare Earth Element

A rare earth element is contained if necessary because it has a function of improving machinability of the alloy without degrading the strength or thermal conductivity and also improving a resistance with respect to an erosion fatigue crack produced by a sulfur component derived from a flux, i.e., improving a sulfur attack resistance. However, if the content of the rare earth element exceeds 0.2%, a hot working property is degraded. Therefore, the content of the rare earth element is determined to be 0.2% or less.

Note that examples of the rare earth element are Ce, La, Nd, Pr, and Sm. The rare earth element may be added and contained using a misch metal which can be easily obtained.

DETAILED DESCRIPTION OF THE INVENTION

Figure 1:
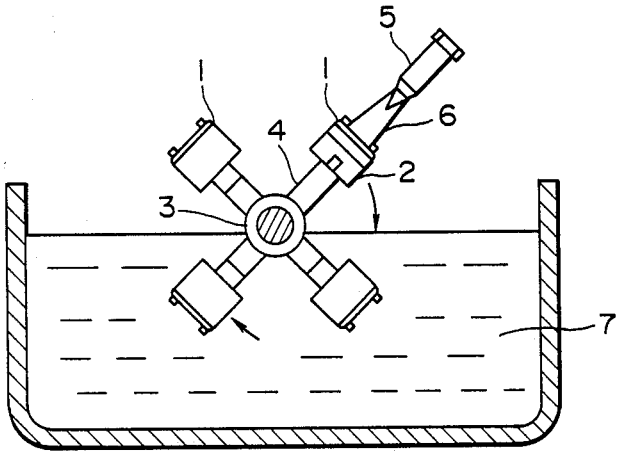
FIG. 1 is a schematic sectional view of a thermal fatigue test apparatus.

The members according to the present invention, the members being made of the Cu alloys as above described, will be described in detail below by way of its examples.

[EXAMPLES]

15 Kg of each of various Cu alloy molten metals having compositions shown in Tables 1-1 to 1-5 were melted in graphite crucibles using a normal vacuum furnace and cast in dies to form three 5 Kg ingots. Each ingot was chamfered and then subjected to hot forging and hot rolling to form a 100 mm wide×5 mm thick plate. The plate was cut out in predetermined lengths, thereby manufacturing Cu alloy plates 1 to 83 of the present invention, comparative Cu alloy plates 1 to 6, and conventional Cu alloy plates 1 to 3.

Note that each Cu alloy plate was held at 980° C. for 30 minutes and then subjected to water cooled quenching. Subsequently, the Cu alloy plates were aged such that the Cu alloy plates 1 to 83 of the present invention and the comparative Cu alloy plates 1 to 6 were held at 525° C. for two hours, the conventional Cu alloy plate 1 was held at 450° C. for an hour, and the conventional Cu alloy plates 2 and 3 were held at 475° C. for two hours, respectively.

Each of the comparative Cu alloy plates 1 to 6 had a composition in which the content represented by * in Table 1 of any of the components falls outside the range of the present invention.

Then, the Vickers hardnesses at room temperature and 500° C. of each of the above various Cu alloy plates were measured, and its electrical conductivities was measured to evaluate the thermal conductivity. Then, the Cu alloy plates were subjected to a room-temperature tensile test, a high-temperature tensile test in which a tensile property was measured after the plate was held at 500° C. for 10 minutes, a heat test, and a thermal cycle fatigue test. Results are shown in Tables 2-1 to 2-4.

In the heat test, temperatures were selected in units of 10° C. within the range of 450° to 700° C., and each test sample was heated up to and at the respective temperatures for an hour, and then air cooled to room temperature to measure its room-temperature hardness. A heating temperature at which the measured value reached 90% of the original room-temperature hardness was listed as a "heat resistant temperature".

In the thermal cycle fatigue test, a thermal fatigue test apparatus shown in FIG. 1 was used. In this test, a test piece 1 having a notch at its central portion was fixed to a test piece holder 2, and the test piece holder 2 was mounted on a holder support rod 4. A flame 6 of a propane gas burner 5 was directed toward the test piece 1 for 40 seconds so that the central portion of the test piece 1 was heated up to a maximum temperature of 500° C.±25° C. Then, a rotary shaft 3 was automatically rotated 90° in the direction of the arrow, thereby immediately quenching the heated test piece 1 with water 7. At the same time, the next test piece 1 was moved to a burner heating position and similarly heated for 40 seconds. 1,000 cycles of this series of operations of heating and cooling were performed for each test piece 1, while an accumulated cycle number was checked when a crack or deformation was produced in the test piece.

Figure 2:
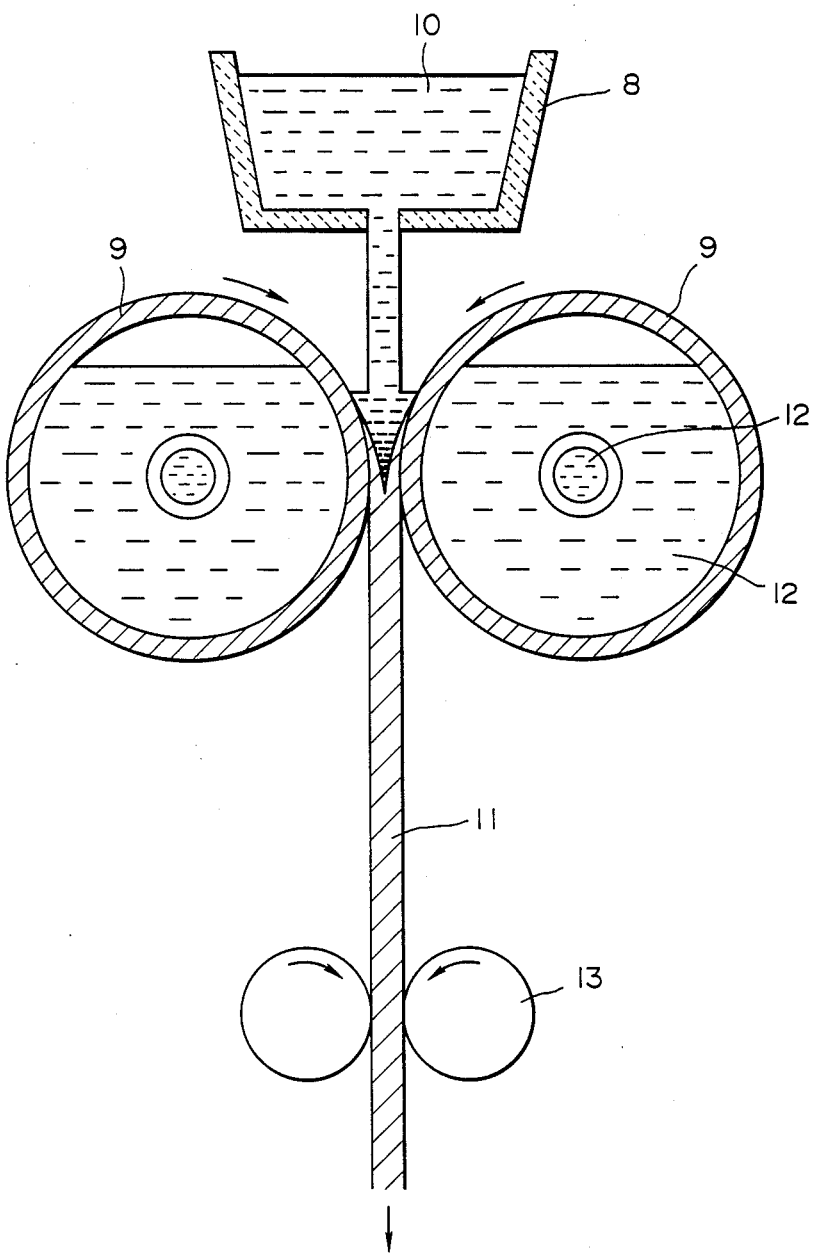
FIG. 2 is a view of a pair of water cooled rotary rolls or twin rolls.

The remaining two ingots were subjected to hot forging to be formed into ring-like products each having an outer diameter of about 105 mm, an inner diameter of about 75 mm, and a width of about 55 mm and then subjected to the heat treatment following the same procedures as described above. Subsequently, the ring-like products were subjected to machining to obtain a size of an outer diameter of 100 mm, an inner diameter of 80 mm, and a width of 50 mm, thereby manufacturing a pair of water cooled rotary roll members as illustrated in FIG. 2. In this drawing, numerals 8, 9, 10, 11, 12 and 13 denote a tundish made of refractory materials such as fire bricks and the like, the water cooled rotary rolls or twin rolls, a molten metal, a cast strip made of the metal, a cooling water and a pinch roll, respectively. The molten metal 10 contained in the tundish 8 is supplied into a narrow space defined between the twin rolls 9. The surfaces of the rotating rolls 9 are cooled by the cooling water 12 supplied into the rolls 9 so as to be circulated therein. Therefore, the molten metal 10 is rapidly cooled by the rolls 9 and is solidified to form the cast strip 11. The cast strip 11 is supplied to the next steps owing to the pinch roll 13.

In order to evaluate the erosion resistance against molten metal of such water cooled rotary rolls, a casting test was performed under the following conditions:

| | |
|---|---|
| rotational frequency; | 30 rpm |
| roll clearance; | 1 mm |
| casting material; | SUS304 (JIS) (AISI 304) |
| casting temperature; | 1,600° C. |
| casting weight; | 5 Kg |

After casting, erosion on the roll surface was observed by with both the naked eye and a stereomicroscope. Symbol o represents a state wherein no or almost no erosion is produced; Δ, a state wherein erosion is slightly produced; and ×, a state wherein erosion is significant. Results are shown in Table 2.

As is apparent from the results shown in Table 2, the mold member alloys 1 to 83 according to the present invention have the room-temperature and high-temperature strengths, the room-temperature and high-temperature hardnesses, the heat resistance, and the thermal fatigue resistance superior to those of the conventional alloys 1 to 3, and also have the excellent thermal conductivity and erosion resistance against molten metal. On the contrary, it is apparent from the comparative examples 1 to 6, at least one of the above characteristics is degraded even if any one component of the composition falls outside the range of the present invention.

Figure 3:
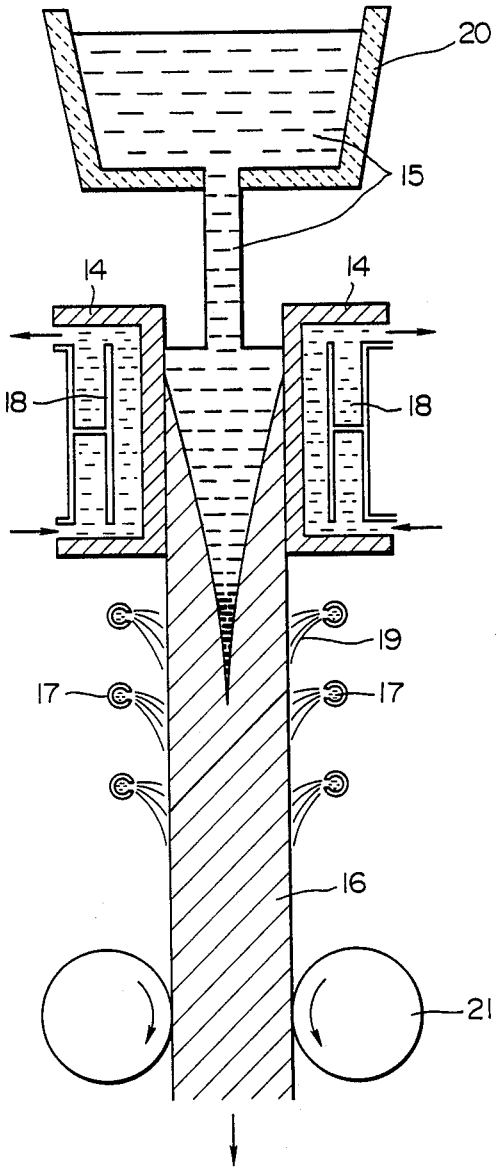
FIG. 3 is a view of a continuous casting mold.

Furthermore, the mold members according to the present invention, the mold members being made of the Cu alloys as above described, can be preferably used as a mold member shown in FIG. 3. In this drawing, numerals 14, 15, 16, 17, 18, 19, 20 and 21 denote a casting mold, a molten metal, a cast slab made of the metal, a secondary cooling water pipe, a primary cooling water, a water jet, a tundish made of refractory materials such as fire bricks and the like, a pinch roll, respectively. The molten metal 15 contained in the tundish 20 is supplied into the casting mold 14 to thereby be gradually cooled. Subsequently, the molten metal 15 passed through the casting mold 14 is further cooled by the water jet 19 splashed by the secondary cooling water pipe 17 to form the cast slab 16. Thus-obtained cast slab 16 is supplied to the next steps owing to the pinch roll 21.

TABLE 1

| Run | | Ni | Ti | Cr | Zr | Al | Fe | Co | Heat Resistance Reinforcing Components | Rare Earth Elements | Cu + Impurities |
|---|---|---|---|---|---|---|---|---|---|---|---|
| P.I. | 1 | 1.36 | 0.98 | 0.48 | — | — | — | — | — | — | Rem. |
| | 2 | 2.52 | 1.02 | 0.51 | — | — | — | — | — | — | " |
| | 3 | 4.95 | 1.01 | 0.49 | — | — | — | — | — | — | " |
| | 4 | 2.48 | 0.23 | 0.47 | — | — | — | — | — | — | " |
| | 5 | 2.45 | 1.94 | 0.52 | — | — | — | — | — | — | " |
| | 6 | 2.47 | 0.99 | 0.12 | — | — | — | — | — | — | " |
| | 7 | 2.51 | 0.97 | 1.47 | — | — | — | — | — | — | " |
| | 8 | 2.60 | 1.03 | 0.50 | 0.013 | — | — | — | — | — | " |
| | 9 | 2.54 | 1.11 | 0.49 | 0.21 | — | — | — | — | — | " |
| | 10 | 2.46 | 1.05 | 0.53 | 0.49 | — | — | — | — | — | " |
| | 11 | 2.50 | 0.99 | 0.51 | — | 0.012 | — | — | — | — | " |
| | 12 | 2.58 | 0.96 | 0.49 | — | 0.97 | — | — | — | — | " |
| | 13 | 2.51 | 0.99 | 0.49 | — | — | 0.012 | — | — | — | " |
| | 14 | 2.49 | 1.08 | 0.50 | — | — | 0.24 | — | — | — | " |
| | 15 | 2.45 | 1.04 | 0.51 | — | — | 0.45 | — | — | — | " |
| | 16 | 2.48 | 1.07 | 0.47 | — | — | — | 0.013 | — | — | " |
| | 17 | 2.49 | 1.05 | 0.51 | — | — | — | 0.26 | — | — | " |
| | 18 | 2.71 | 0.96 | 0.49 | — | — | — | 0.46 | — | — | " |
| | 19 | 2.54 | 1.04 | 0.46 | — | — | 0.12 | 0.15 | — | — | " |

TABLE 1-continued

| Run | Ni | Ti | Cr | Zr | Al | Fe | Co | Heat Resistance Reinforcing Components | Rare Earth Elements | Cu + Impurities |
|---|---|---|---|---|---|---|---|---|---|---|
| 20 | 2.61 | 1.05 | 0.47 | — | — | — | — | Sn 0.053 | — | " |
| 21 | 2.44 | 0.98 | 0.51 | — | — | — | — | Mn 0.54 | — | " |
| 22 | 2.70 | 1.00 | 0.52 | — | — | — | — | Zn 1.09 | — | " |
| 23 | 2.60 | 1.04 | 0.48 | — | — | — | — | Mg 0.03 | — | " |
| 24 | 2.54 | 1.01 | 0.46 | — | — | — | — | P 0.0014 | — | " |
| 25 | 2.49 | 1.08 | 0.54 | — | — | — | — | Sn 0.46 Mg 0.10 | — | " |
| 26 | 2.47 | 0.99 | 0.50 | — | — | — | — | Mn 0.056 P 0.18 | — | " |
| 27 | 2.52 | 0.98 | 0.52 | — | — | — | — | Sn 1.03 Zn 0.67 Mg 0.0019 | — | " |
| 28 | 2.50 | 1.11 | 0.54 | — | — | — | — | — | La 0.18 | " |
| 29 | 2.54 | 1.07 | 0.50 | — | — | — | — | — | Ce 0.0012 | " |
| 30 | 2.59 | 1.04 | 0.50 | — | — | — | — | — | Ce 0.05 | " |
| | | | | | | | | — | Nd 0.02 | |
| | | | | | | | | — | La 0.02 | |
| 31 | 2.55 | 1.01 | 0.51 | 0.22 | 0.30 | — | — | — | — | " |
| 32 | 2.57 | 1.03 | 0.48 | 0.12 | — | — | 0.16 | — | — | " |
| 33 | 2.51 | 1.03 | 0.51 | 0.32 | — | 0.11 | 0.10 | — | — | " |
| 34 | 2.46 | 1.01 | 0.50 | 0.04 | — | — | — | Mn 0.32 | — | " |
| 35 | 2.52 | 0.98 | 0.46 | 0.38 | — | — | — | Sn 0.33 P 0.11 | — | " |
| 36 | 2.49 | 1.04 | 0.49 | 0.05 | — | — | — | — | Ce 0.13 | " |
| 37 | 2.52 | 0.96 | 0.52 | 0.30 | — | — | — | — | La 0.05 Ce 0.06 | " |
| 38 | 2.50 | 0.98 | 0.48 | — | 0.33 | 0.26 | — | — | — | " |
| 39 | 2.46 | 0.96 | 0.50 | — | 0.34 | — | 0.23 | — | — | " |
| 40 | 2.52 | 0.96 | 0.51 | — | 0.32 | 0.06 | 0.09 | — | — | " |
| 41 | 2.44 | 1.01 | 0.50 | — | 0.31 | — | — | Zn 0.21 | — | " |
| 42 | 2.53 | 0.98 | 0.51 | — | 0.33 | — | — | Mn 0.66 Mg 0.06 | — | " |
| 43 | 2.52 | 0.96 | 0.50 | — | 0.30 | — | — | — | Ce 0.18 | " |
| 44 | 2.51 | 1.03 | 0.52 | — | 0.31 | — | — | — | Ce 0.10 Nd 0.04 La 0.04 | " |
| 45 | 2.54 | 1.06 | 0.54 | — | — | 0.12 | — | Sn 1.19 Zn 0.054 | — | " |
| 46 | 2.61 | 1.08 | 0.53 | — | — | — | 0.06 | P 0.18 | — | " |
| 47 | 2.55 | 1.01 | 0.50 | — | — | 0.21 | 0.16 | — | Nd 0.08 Pr 0.01 | " |
| 48 | 2.55 | 1.00 | 0.48 | — | — | 0.14 | — | — | La 0.0013 | " |
| 49 | 2.48 | 1.09 | 0.51 | — | — | — | — | Mn 0.08 Zn 0.12 | Ce 0.09 | " |
| 50 | 2.50 | 1.12 | 0.50 | — | — | — | — | Mg 0.19 | Ce 0.03 Nd 0.01 La 0.02 | " |
| 51 | 2.48 | 1.03 | 0.51 | 0.11 | 0.29 | 0.23 | — | — | — | " |
| 52 | 2.46 | 1.01 | 0.51 | 0.34 | 0.29 | 0.13 | 0.12 | — | — | " |
| 53 | 2.51 | 1.00 | 0.50 | 0.012 | 0.33 | — | — | Sn 0.053 | — | " |
| 54 | 2.50 | 0.96 | 0.50 | 0.21 | 0.31 | — | — | Mn 0.63 Zn 0.059 P 0.06 | — | " |
| 55 | 2.62 | 0.96 | 0.48 | 0.16 | 0.30 | — | — | — | La 0.11 | " |
| 56 | 2.54 | 0.98 | 0.52 | 0.32 | 0.30 | — | — | — | Ce 0.05 Nd 0.02 La 0.02 | " |
| 57 | 2.54 | 1.08 | 0.52 | 0.013 | — | — | 0.11 | Zn 0.054 | | " |
| 58 | 2.47 | 1.06 | 0.49 | 0.43 | — | 0.21 | 0.25 | Zn 0.88 Mg 0.06 P 0.06 | | " |
| 59 | 2.53 | 1.07 | 0.48 | 0.21 | — | 0.16 | — | — | Ce 0.0016 | " |
| 60 | 2.57 | 1.10 | 0.52 | 0.12 | — | — | 0.42 | — | La 0.09 | " |
| 61 | 2.54 | 1.06 | 0.50 | 0.014 | — | — | — | P 0.08 | Ce 0.0013 | " |
| 62 | 2.50 | 1.14 | 0.48 | 0.28 | — | — | — | Sn 1.04 Mg 0.0012 | La 0.0016 | " |
| 63 | 2.50 | 1.02 | 0.51 | — | 0.29 | 0.34 | — | P 0.16 | — | " |
| 64 | 2.47 | 1.03 | 0.52 | — | 0.34 | 0.21 | 0.23 | Mn 0.054 Mg 0.19 | — | " |
| 65 | 2.49 | 0.97 | 0.50 | — | 0.34 | — | 0.33 | — | Nd 0.04 Pr 0.01 | " |
| 66 | 2.49 | 0.97 | 0.48 | — | 0.31 | 0.25 | — | — | La 0.16 | |
| 67 | 2.60 | 1.04 | 0.52 | — | 0.29 | — | — | Mn 0.31 | Ce 0.01 La 0.02 | " |
| 68 | 2.46 | 1.02 | 0.50 | — | 0.33 | — | — | Mg 0.12 | Ce 0.006 | " |
| 69 | 2.46 | 0.96 | 0.49 | — | — | 0.05 | — | Mg 0.0012 | La 0.09 | " |
| 70 | 2.53 | 0.99 | 0.51 | — | — | 0.03 | 0.09 | Sn 0.07 Mg 0.04 P 0.03 | Ce 0.06 La 0.05 | " |
| 71 | 2.51 | 1.03 | 0.50 | 0.013 | 0.32 | — | 0.04 | Sn 0.09 P 0.008 | — | " |
| 72 | 2.59 | 0.95 | 0.51 | 0.46 | 0.30 | 0.32 | 0.11 | Zn 0.056 | — | " |
| 73 | 2.48 | 0.95 | 0.49 | 0.26 | 0.31 | — | 0.36 | — | Ce 0.07 Nd 0.03 La 0.03 | " |
| 74 | 2.49 | 0.99 | 0.53 | 0.41 | 0.32 | 0.01 | 0.02 | — | Ce 0.01 | " |
| 75 | 2.50 | 1.03 | 0.50 | 0.04 | 0.32 | — | — | P 0.09 | La 0.06 | " |
| 76 | 2.51 | 0.96 | 0.50 | 0.10 | 0.32 | — | — | Sn 0.09 Mn 0.08 Mg 0.06 | Ce 0.0016 | " |
| 77 | 2.47 | 1.05 | 0.50 | 0.11 | — | — | 0.12 | Sn 0.13 | Ce 0.01 | " |
| 78 | 2.47 | 1.08 | 0.46 | 0.26 | — | 0.13 | 0.10 | Zn 0.54 P 0.04 | Ce 0.03 | " |
| 79 | 2.48 | 0.96 | 0.54 | — | 0.30 | — | 0.06 | Sn 0.25 | La 0.01 | " |
| 80 | 2.51 | 1.02 | 0.48 | — | 0.31 | 0.06 | 0.12 | Zn 0.10 Mg 0.009 | Ce 0.01 | " |

TABLE 1-continued

| Run | | Ni | Ti | Cr | Zr | Al | Fe | Co | Heat Resistance Reinforcing Components | Rare Earth Elements | Cu + Impurities |
|---|---|---|---|---|---|---|---|---|---|---|---|
| | | | | | | | | | | La 0.02 | |
| | 81 | 2.46 | 1.00 | 0.49 | 0.49 | 0.28 | 0.01 | 0.01 | Zn 0.11 | Ce 0.04 | " |
| | 82 | 2.54 | 1.00 | 0.51 | 0.21 | 0.32 | 0.16 | — | P 0.06 | Ce 0.02 | " |
| | | | | | | | | | | La 0.01 | |
| | 83 | 2.50 | 0.94 | 0.52 | 0.36 | 0.31 | 0.24 | 0.25 | Mn 0.13 Zn 0.68 | Ce 0.02 | " |
| | | | | | | | | | Mg 0.13 | Nd 0.01 | |
| | | | | | | | | | | La 0.01 | |
| CM | 1 | 1.12* | 0.98 | 0.47 | — | — | — | — | — | — | " |
| | 2 | 5.23* | 1.01 | 0.51 | — | — | — | — | — | — | " |
| | 3 | 2.52 | 0.18* | 0.48 | — | — | — | — | — | — | " |
| | 4 | 2.48 | 2.14* | 0.52 | — | — | — | — | — | — | " |
| | 5 | 2.50 | 1.00 | 0.08* | — | — | — | — | — | — | " |
| | 6 | 2.49 | 0.99 | 1.54* | — | — | — | — | — | — | " |
| CN | 1 | — | — | 0.63 | — | — | — | — | — | — | " |
| | 2 | — | — | — | 0.11 | — | — | — | — | — | " |
| | 3 | — | — | 0.62 | 0.12 | — | — | — | — | — | " |

P.I. — Cu Alloy Plates of the Present Invention
CM — Comparative Cu Alloy Plates
CN — Conventional Cu Alloy Plates

TABLE 2

| Run | | Room Temperature Tensile Property A (kg/mm²) | B (kg/mm²) | C (%) | High-Temperature Tensile Property A (kg/mm²) | B (kg/mm²) | C (%) | Vicker Hardness D (Hv) | E (Hv) | Electrical Conductivities (% IACS) | Heat Resistant Temperature (°C.) | Heating Cycle for Cracking or Deformation Appearance F | G | Erosion on the Roll Surface |
|---|---|---|---|---|---|---|---|---|---|---|---|---|---|---|
| P.I. | 1 | 59.8 | 48.5 | 23.5 | 35.1 | 33.8 | 14.5 | 196 | 145 | 58.3 | 640 | None | None | Δ |
| | 2 | 65.3 | 53.2 | 18.4 | 39.4 | 38.1 | 8.5 | 235 | 168 | 53.5 | 650 | None | None | Δ |
| | 3 | 67.3 | 55.1 | 15.4 | 41.2 | 39.6 | 8.0 | 240 | 171 | 48.2 | 650 | None | None | Δ |
| | 4 | 58.9 | 47.5 | 22.4 | 34.3 | 33.5 | 15.0 | 198 | 143 | 59.6 | 630 | None | None | Δ |
| | 5 | 67.2 | 55.6 | 14.9 | 41.5 | 39.8 | 8.1 | 242 | 172 | 45.1 | 650 | None | None | Δ |
| | 6 | 58.9 | 47.5 | 23.7 | 34.1 | 33.5 | 15.3 | 194 | 143 | 59.6 | 640 | None | None | Δ |
| | 7 | 66.9 | 55.3 | 16.5 | 41.1 | 38.9 | 8.2 | 245 | 173 | 47.9 | 650 | None | None | Δ |
| | 8 | 65.5 | 53.8 | 18.7 | 41.3 | 37.9 | 11.0 | 220 | 152 | 52.5 | 670 | None | None | Δ |
| | 9 | 65.7 | 53.5 | 18.5 | 41.2 | 38.3 | 11.5 | 221 | 153 | 52.7 | 670 | None | None | Δ |
| | 10 | 66.1 | 54.1 | 19.0 | 41.5 | 39.1 | 12.0 | 225 | 160 | 51.2 | 680 | None | None | Δ |
| | 11 | 67.5 | 55.4 | 18.2 | 41.7 | 40.3 | 8.1 | 247 | 178 | 50.8 | 650 | None | None | O |
| | 12 | 72.0 | 59.8 | 16.9 | 46.0 | 44.6 | 7.5 | 258 | 188 | 40.5 | 660 | None | None | O |
| | 13 | 65.8 | 53.7 | 18.0 | 40.0 | 38.6 | 8.3 | 238 | 170 | 54.0 | 650 | None | None | Δ |
| | 14 | 66.3 | 54.1 | 17.5 | 40.5 | 39.3 | 8.2 | 240 | 171 | 54.5 | 650 | None | None | Δ |
| | 15 | 66.8 | 54.7 | 17.1 | 41.1 | 39.9 | 8.0 | 242 | 173 | 54.6 | 650 | None | None | Δ |
| | 16 | 65.7 | 53.8 | 18.1 | 40.1 | 38.5 | 8.3 | 239 | 170 | 54.1 | 650 | None | None | Δ |
| | 17 | 66.4 | 54.0 | 17.6 | 40.6 | 39.4 | 8.1 | 241 | 171 | 54.6 | 650 | None | None | Δ |
| | 18 | 66.9 | 54.8 | 17.2 | 41.2 | 40.1 | 8.0 | 243 | 173 | 54.5 | 650 | None | None | Δ |
| | 19 | 66.3 | 54.1 | 17.5 | 40.5 | 39.5 | 8.1 | 242 | 171 | 54.5 | 650 | None | None | Δ |
| | 20 | 65.8 | 53.5 | 18.2 | 39.7 | 38.2 | 8.4 | 236 | 169 | 53.0 | 660 | None | None | Δ |
| | 21 | 66.3 | 53.8 | 18.1 | 40.2 | 38.7 | 8.2 | 238 | 170 | 51.0 | 680 | None | None | Δ |
| | 22 | 66.9 | 54.3 | 17.8 | 40.8 | 39.2 | 8.0 | 239 | 171 | 50.0 | 690 | None | None | Δ |
| | 23 | 65.7 | 53.4 | 18.2 | 39.7 | 38.2 | 8.3 | 236 | 169 | 53.1 | 660 | None | None | Δ |
| | 24 | 65.8 | 53.5 | 18.1 | 39.8 | 38.3 | 8.2 | 237 | 169 | 53.2 | 660 | None | None | Δ |
| | 25 | 66.4 | 53.9 | 18.0 | 40.9 | 39.1 | 8.1 | 240 | 170 | 50.1 | 690 | None | None | Δ |
| | 26 | 67.0 | 54.4 | 17.7 | 41.3 | 40.0 | 7.9 | 241 | 172 | 49.8 | 690 | None | None | Δ |
| | 27 | 67.5 | 54.5 | 17.5 | 41.7 | 40.5 | 7.6 | 243 | 173 | 49.3 | 690 | None | None | Δ |
| | 28 | 65.3 | 53.1 | 18.4 | 39.3 | 38.1 | 8.4 | 235 | 169 | 53.4 | 650 | None | None | Δ |
| | 29 | 65.4 | 53.2 | 18.3 | 39.4 | 38.1 | 8.4 | 236 | 169 | 53.3 | 650 | None | None | Δ |
| | 30 | 65.3 | 53.0 | 18.2 | 39.2 | 38.0 | 8.5 | 234 | 168 | 53.4 | 650 | None | None | Δ |
| | 31 | 70.6 | 58.3 | 17.5 | 46.2 | 43.3 | 10.5 | 236 | 168 | 44.6 | 670 | None | None | O |
| | 32 | 65.8 | 53.6 | 18.6 | 41.3 | 38.4 | 11.4 | 222 | 153 | 52.7 | 670 | None | None | Δ |
| | 33 | 65.9 | 53.8 | 18.5 | 41.7 | 38.9 | 11.5 | 223 | 154 | 52.1 | 670 | None | None | Δ |
| | 34 | 65.6 | 54.0 | 18.6 | 41.5 | 38.0 | 11.2 | 221 | 153 | 52.6 | 680 | None | None | Δ |
| | 35 | 66.2 | 54.2 | 19.0 | 41.6 | 39.2 | 12.1 | 226 | 161 | 51.0 | 690 | None | None | Δ |
| | 36 | 65.5 | 53.9 | 18.8 | 41.2 | 37.8 | 11.1 | 220 | 152 | 52.4 | 670 | None | None | Δ |
| | 37 | 65.8 | 53.9 | 18.6 | 41.3 | 38.4 | 11.7 | 222 | 154 | 52.8 | 670 | None | None | Δ |
| | 38 | 71.2 | 59.2 | 16.6 | 45.5 | 44.3 | 7.2 | 255 | 186 | 46.5 | 660 | None | None | O |
| | 39 | 71.4 | 59.1 | 16.5 | 45.5 | 44.3 | 7.2 | 256 | 186 | 46.5 | 660 | None | None | O |
| | 40 | 71.4 | 59.2 | 16.5 | 45.5 | 44.4 | 7.2 | 257 | 185 | 46.5 | 660 | None | None | O |
| | 41 | 71.0 | 59.3 | 16.5 | 46.0 | 44.7 | 7.3 | 258 | 186 | 45.0 | 680 | None | None | O |
| | 42 | 71.5 | 60.1 | 16.2 | 46.2 | 45.1 | 7.2 | 261 | 189 | 44.8 | 690 | None | None | O |
| | 43 | 70.3 | 58.5 | 17.2 | 44.5 | 43.3 | 7.7 | 252 | 181 | 45.1 | 650 | None | None | O |
| | 44 | 70.5 | 58.4 | 17.3 | 44.6 | 43.2 | 7.8 | 252 | 181 | 45.2 | 650 | None | None | O |
| | 45 | 66.4 | 54.2 | 17.4 | 40.8 | 39.5 | 8.3 | 241 | 170 | 54.6 | 670 | None | None | Δ |
| | 46 | 65.6 | 53.9 | 18.2 | 40.2 | 38.4 | 8.2 | 238 | 170 | 54.2 | 670 | None | None | Δ |
| | 47 | 66.8 | 54.8 | 17.1 | 41.0 | 40.0 | 8.1 | 242 | 172 | 54.7 | 650 | None | None | Δ |
| | 48 | 66.3 | 54.2 | 17.4 | 40.6 | 39.4 | 8.2 | 241 | 170 | 54.3 | 650 | None | None | Δ |
| | 49 | 66.2 | 53.7 | 18.2 | 40.3 | 38.7 | 8.1 | 237 | 169 | 51.0 | 680 | None | None | Δ |
| | 50 | 66.9 | 54.2 | 17.9 | 40.9 | 39.3 | 8.1 | 240 | 171 | 50.1 | 690 | None | None | Δ |

TABLE 2-continued

| Run | Room Temperature Tensile Property A (kg/mm²) | B (kg/mm²) | C (%) | High-Temperature Tensile Property A (kg/mm²) | B (kg/mm²) | C (%) | Vicker Hardness D (Hv) | E (Hv) | Electrical Conductivities (% IACS) | Heat Resistant Temperature (°C.) | Heating Cycle for Cracking or Deformation Appearance F | G | Erosion on the Roll Surface |
|---|---|---|---|---|---|---|---|---|---|---|---|---|---|
| 51 | 71.3 | 59.2 | 17.4 | 46.8 | 44.0 | 10.5 | 240 | 170 | 44.5 | 670 | None | None | O |
| 52 | 71.5 | 59.4 | 17.3 | 47.0 | 44.2 | 10.4 | 241 | 171 | 44.3 | 670 | None | None | O |
| 53 | 70.6 | 58.9 | 17.8 | 46.5 | 43.1 | 10.2 | 236 | 168 | 44.6 | 680 | None | None | O |
| 54 | 71.2 | 59.5 | 17.2 | 47.2 | 44.3 | 10.3 | 240 | 172 | 44.3 | 690 | None | None | O |
| 55 | 70.3 | 58.2 | 17.6 | 46.0 | 43.0 | 10.6 | 234 | 166 | 44.8 | 670 | None | None | O |
| 56 | 70.8 | 58.7 | 17.4 | 46.5 | 43.5 | 10.4 | 240 | 170 | 44.3 | 670 | None | None | O |
| 57 | 65.8 | 54.1 | 18.5 | 41.7 | 38.3 | 11.1 | 222 | 154 | 52.0 | 680 | None | None | Δ |
| 58 | 66.9 | 55.0 | 18.5 | 42.3 | 40.0 | 12.1 | 228 | 163 | 50.1 | 690 | None | None | Δ |
| 59 | 66.2 | 54.1 | 18.6 | 41.7 | 38.4 | 11.7 | 224 | 156 | 52.5 | 670 | None | None | Δ |
| 60 | 66.1 | 54.0 | 18.4 | 41.8 | 38.8 | 11.4 | 224 | 155 | 52.0 | 670 | None | None | Δ |
| 61 | 65.6 | 53.9 | 18.7 | 41.5 | 38.1 | 11.0 | 221 | 152 | 52.4 | 680 | None | None | Δ |
| 62 | 65.9 | 54.1 | 18.2 | 41.7 | 38.8 | 11.3 | 224 | 155 | 52.5 | 690 | None | None | Δ |
| 63 | 72.1 | 60.5 | 15.6 | 46.5 | 45.2 | 7.3 | 258 | 189 | 46.4 | 680 | None | None | O |
| 64 | 72.0 | 60.7 | 15.2 | 47.1 | 46.0 | 7.2 | 261 | 190 | 45.1 | 680 | None | None | O |
| 65 | 71.5 | 59.5 | 16.5 | 45.9 | 44.8 | 7.2 | 255 | 185 | 46.8 | 660 | None | None | O |
| 66 | 71.3 | 59.2 | 16.6 | 45.5 | 44.2 | 7.1 | 254 | 186 | 46.3 | 660 | None | None | O |
| 67 | 71.1 | 59.3 | 16.4 | 46.1 | 44.7 | 7.3 | 257 | 185 | 46.7 | 680 | None | None | O |
| 68 | 71.2 | 59.2 | 16.5 | 46.0 | 44.5 | 7.4 | 256 | 183 | 46.8 | 680 | None | None | O |
| 69 | 65.7 | 53.6 | 18.1 | 39.8 | 38.5 | 8.4 | 237 | 169 | 53.9 | 680 | None | None | Δ |
| 70 | 66.2 | 54.0 | 17.6 | 40.3 | 39.1 | 8.2 | 240 | 170 | 54.4 | 680 | None | None | Δ |
| 71 | 71.5 | 59.7 | 17.5 | 47.3 | 43.4 | 10.3 | 240 | 171 | 44.2 | 690 | None | None | O |
| 72 | 72.1 | 60.2 | 17.2 | 47.5 | 45.5 | 11.0 | 245 | 180 | 42.5 | 690 | None | None | O |
| 73 | 71.2 | 59.3 | 17.2 | 47.1 | 44.2 | 10.4 | 241 | 172 | 45.5 | 670 | None | None | O |
| 74 | 72.1 | 60.1 | 17.2 | 47.4 | 45.2 | 11.2 | 245 | 181 | 42.5 | 670 | None | None | O |
| 75 | 70.5 | 58.9 | 17.8 | 46.2 | 43.0 | 10.1 | 236 | 168 | 44.6 | 690 | None | None | O |
| 76 | 71.4 | 59.3 | 17.0 | 47.1 | 44.2 | 10.3 | 239 | 171 | 44.5 | 690 | None | None | O |
| 77 | 65.8 | 53.7 | 18.5 | 41.4 | 38.5 | 11.5 | 223 | 154 | 52.6 | 680 | None | None | Δ |
| 78 | 66.0 | 54.0 | 18.4 | 41.8 | 39.1 | 11.7 | 224 | 155 | 52.0 | 680 | None | None | Δ |
| 79 | 71.5 | 59.7 | 16.1 | 46.0 | 44.3 | 7.2 | 257 | 189 | 45.3 | 690 | None | None | O |
| 80 | 71.8 | 59.9 | 16.0 | 46.2 | 44.5 | 7.1 | 260 | 191 | 45.1 | 690 | None | None | O |
| 81 | 72.5 | 60.8 | 17.1 | 47.9 | 45.6 | 11.0 | 248 | 182 | 42.1 | 690 | None | None | O |
| 82 | 72.4 | 60.7 | 17.0 | 47.8 | 45.8 | 11.1 | 251 | 183 | 42.2 | 690 | None | None | O |
| 83 | 72.8 | 61.3 | 16.5 | 48.3 | 46.2 | 11.0 | 256 | 185 | 40.3 | 690 | None | None | O |
| 1 | 51.2 | 41.3 | 24.5 | 29.8 | 27.8 | 15.1 | 181 | 132 | 55.3 | 610 | 600 | 500 | X |
| 2 | 67.5 | 55.4 | 14.8 | 41.5 | 39.7 | 7.5 | 242 | 172 | 41.3 | 640 | 700 | None | Δ |
| 3 | 51.3 | 41.5 | 25.1 | 29.7 | 27.6 | 14.9 | 182 | 131 | 55.4 | 610 | 600 | 500 | X |
| 4 | 67.4 | 55.5 | 14.7 | 41.3 | 39.8 | 7.2 | 243 | 171 | 41.2 | 630 | 700 | None | Δ |
| 5 | 52.1 | 40.3 | 24.4 | 29.6 | 27.9 | 15.0 | 181 | 129 | 55.3 | 600 | 600 | 600 | X |
| 6 | 68.4 | 55.3 | 11.5 | 41.7 | 39.8 | 5.3 | 245 | 175 | 53.2 | 650 | 500 | None | Δ |
| 1 | 39.1 | 27.3 | 33.4 | 16.4 | 14.7 | 2.1 | 115 | 61 | 80.0 | 490 | 300 | 200 | X |
| 2 | 35.1 | 24.1 | 32.2 | 16.5 | 14.1 | 25.7 | 113 | 63 | 85.3 | 520 | None | 300 | X |
| 3 | 39.4 | 27.3 | 32.1 | 19.6 | 18.2 | 29.4 | 117 | 73 | 79.5 | 540 | None | 300 | X |

A — Tensile Strength
B — 0.2% Yield Strength
C — Elongation
D — Room Temperature
E — 500° C.
F — Cracking
G — Deformation

What is claimed is:

1. A mold member made of an alloy containing 1.3 to 5% of Ni, 0.2 to 2% of Ti, 0.1 to 1.5% of Cr, 0 to 0.5% of Zr, 0 to 1% of Al, 0 to 0.5% of at least one of Fe and Co, 0 to 1.2% of Sn, 0 to 1.2% of Mn, 0 to 1.2% of Zn, 0 to 0.2% of Mg, 0 to 0.2% of P, and 0 to 0.2% of a rare earth element, wherein the remainder of said alloy has a composition consisting of Cu and unavoidable impurities.

2. A member according to claim 1, wherein a content of Zr is 0.01 to 0.5%.

3. A rapidly solidifying water cooled rotary roll member made of an alloy containing 1.3 to 5% of Ni, 0.2 to 2% of Ti, 0.1 to 1.5% of Cr, 0 to 0.5% of Zr, 0 to 1% of Al, 0 to 0.5% of at least one of Fe and Co, 0 to 1.2% of Sn, 0 to 1.2% of Mn, 0 to 1.2% of Zn, 0 to 0.2% of Mg, 0 to 0.2% of P, and 0 to 0.2% of a rare earth element, wherein the remainder of said alloy has a composition consisting of Cu and unavoidable impurities.

4. A member according to claim 3, wherein a content of Zr is 0.01 to 0.5%.

* * * * *